US006020865A

United States Patent [19]

Okuda et al.

[11] Patent Number: 6,020,865

[45] Date of Patent: Feb. 1, 2000

[54] DRIVING METHOD AND APPARATUS FOR LIGHT EMITTING DEVICE

[75] Inventors: Yoshiyuki Okuda; Hideo Ochi; Shinichi Ishizuka, all of Tsurugashima, Japan

[73] Assignee: Pioneer Electronic Corporation, Tokyo, Japan

[21] Appl. No.: 08/725,037

[22] Filed: Oct. 2, 1996

[30] Foreign Application Priority Data

Oct. 4, 1995 [JP] Japan ..... 7-257537

[51] Int. Cl.[7] ..... G09G 3/32

[52] U.S. Cl. ..... 345/82; 345/147

[58] Field of Search ..... 345/77, 82, 89, 345/147, 148, 149; 358/456, 457, 458, 459

[56] References Cited

U.S. PATENT DOCUMENTS 3,742,483 6/1973 Ogle ..... 345/147

5,619,228 4/1997 Doherty ..... 345/69

*Primary Examiner*—Dennis-Doon Chow

*Attorney, Agent, or Firm*—Morgan, Lewis & Bockius LLP

[57] ABSTRACT

Driving method and apparatus for a light emitting device have a simple configuration and are able to change the luminance even when a light emitting device which operates at a low speed is employed. The apparatus includes power supplies numbering n each generating different output, switches numbering n to turn the outputs of the power supplies on/off and an adder to add the outputs from the switches and drive the light emitting device. The control information to control the n switches for each divided section obtained by dividing a lighting period by k is stored in the control information storing part and the control information for each divided section is read out to turn on/off the n switches.

20 Claims, 3 Drawing Sheets

| ADDRESS | N DIGITS |
|---|---|
| 0---0 0 | 0----01 |
| 0---0 1 | 0----10 |
| | |
| k-1 | 00---00 |

DRIVING METHOD AND APPARATUS FOR LIGHT EMITTING DEVICE

BACKGROUND OF THE INVENTION

1. Field of the Invention

The present invention relates to driving method and apparatus to activate a light emitting device.

2. Description of the Related Art

Display units using a light emitting device are widely used in electronic devices of nowadays. In some cases, a desired display is achieved by changing the luminance of the light emitting device. There also are cases where luminous intensities of light emitting devices each having different shape and emitting area are adjusted to match with each other.

Conventionally, the luminance of a light emitting device is changed by using a plurality of power supplies each generating a different output level. Among plural outputs from those power supplies, outputs which can be used to produce desired luminance are selected by using switches and resulting outputs are summed to drive a light emitting device.

Alternatively, a light emitting device is activated by a pulse-width modulated output which, correspondingly to a desired luminance level, assumes an output level of a power supply, that generates a specified output, for a period corresponding to any number from 0 through k of divided sections obtained by dividing a luminous period of a light emitting device by "k".

As described above, in conventional cases, the luminance of a light emitting device is changed by using two or more power supplies numbers of which is determined to be an n-th power (n being an integer) of 2 as usually seen in the design of D/A converters and the outputs which together produce desired luminance are summed to activate a light emitting device. The pulse-width modulated signal is also used for activating a light emitting device as explained above.

Therefore, in the former example, as the number of steps of the luminous intensity is increased, more numbers of power supplies are required to generate such different outputs accordingly. In the latter example, as the number of steps of luminance intensity is increased, the length of time which can be allocated to each divided section becomes shorter. This, as a result, requires a light emitting device which can operate at a high speed so that light emission is possible even in such a short time.

OBJECTS AND SUMMARY OF THE INVENTION

It is an object of the present invention to provide a driving method and apparatus for a light emitting device, which are simply configured and are capable of changing the luminous intensity even by using a light emitting device operating at a low speed. measures taken by the present inventor to achieve the above object are described below.

According to the first aspect of the present invention, a driving method for driving a light emitting device comprises steps of: generating n driving outputs, n being an integer, driving said light emitting device by using a driving signal obtained by selectively summing generated n driving outputs, wherein the selection of n driving outputs is performed by switching on/off specified switches for each of divided sections obtained by dividing a lighting period of a light emitting device by k.

According to the second aspect of the present invention, the output value of the i-th driving output, i being an integer, of the n driving outputs is determined to be $I\cdot(k+1)^{i-1}$, where k represents the number of division of the lighting period and I is a minimum output value.

According to the third aspect of the present invention, switches are turned on/off for each of the divided sections according to values weighted by luminous areas of the light emitting elements in the light emitting device.

According to the fourth aspect of the present invention, said n different output values are constant-current values or constant-voltage values.

According to the fifth aspect of the present invention, said switches are turned on/off for a plurality of light emitting elements and the turning on/off of switches is repeatedly performed for each of the light emitting elements to be activated sequentially, and the outputs are summed to produce the drive signal.

According to the sixth aspect of the present invention, a driving apparatus for driving a light emitting device comprises n power supplies each generating a different output, n switches to turn on/off outputs from the n power supplies respectively, an adder which is used to sum outputs from the n switches numbering and to activate the light emitting device, a period dividing part which divides a lighting period of the light emitting device by k, a control information storing part to store control information to turn on/off the n switches for each of the k divided sections obtained by using said the period dividing part, and a switch control part which reads out control information from said control information storing part for each of divided section obtained by dividing the lighting period using the period dividing part and turns on/off the n switches numbering. The n switches are connected to the n power supplies each generating a different output respectively, to turn on/off their outputs.

The adder is used to sum outputs from the n switches, and activate the light emitting device.

The period dividing part is used to divide the lighting period of the light emitting device by k.

The control information storing part is used to store control information to turn on/off the n switches numbering for each of the divided section obtained by dividing the lighting period by k.

The switch control part is used to read out control information for each of the divided section obtained by dividing the lighting period using said period dividing part and to turn on/off the n switches.

According to the seventh aspect of the present invention, the output value of the i-th, i being an integer, power supply of the n power supplies is determined to be $I\cdot(k+1)^{i-1}$ where k represents the number of divided sections obtained by said period dividing part in said driving apparatus, and I represents a minimum output.

According to the eighth aspect of the present invention, control information stored in said control information storing part is information to turn on/off the n switches produced by weighting according to luminous areas of the light emitting element for each of the divided sections.

According to the ninth characteristic of the present invention, said power supplies are constant-current power supplies or constant-voltage power supplies.

According to the tenth aspect of the present invention, control information pieces corresponding to a plurality of light emitting elements are stored in said control information storing part, and the switch control part reads out each of the control information pieces corresponding to a light emitting element to be activated sequentially and the control the is performed for the light emitting element.

As described above, the outputs through switches connected to n power supplies each generating a different output are summed and the light emitting device is driven by using the summed output. By the scheme where the switches are on/off based on the information stored for each of the divided sections of the device's lighting period which is divided by k, the number of the power supplies each generating different output can be decreased. This allows the cost of the light emitting device to be reduced and the light emitting device to be driven using all divided sections of the lighting period.

Thus the peak of driving values are lowered and the light emitting device as activated at a low speed.

Moreover, the device of the present invention is configured in such a manner that the output, which is proportional to $(k+1)^{i-1}$ is produced for the i-th of the n power supplies, thus many steps driving values are obtained by few power supply.

According to the another aspect, the switches are turned on/off for each of the divided sections based on control values weighted by light emitting areas of the light emitting elements, thus allowing the device to be activated at a desired luminance even if a light emitting device having a different luminous area is incorporated in the display. The power is easily supplied because the device uses either the constant-current or constant-voltage regulated power supply.

The light emitting device of the present invention can provide control information to turn on/off the n outputs for a plurality of light emitting devices so that the output is generated to activate the corresponding one of the light emitting elements in turn based a plurality of control information pieces. This allows a plurality of light emitting devices to be activated by single output, thus simplifying the structure of the apparatus.

DETAILED DESCRIPTION OF THE PREFERRED EMBODIMENTS

An embodiment of the present invention will be described with reference to a block diagram shown in FIG. 1.

Figures 1, 2:
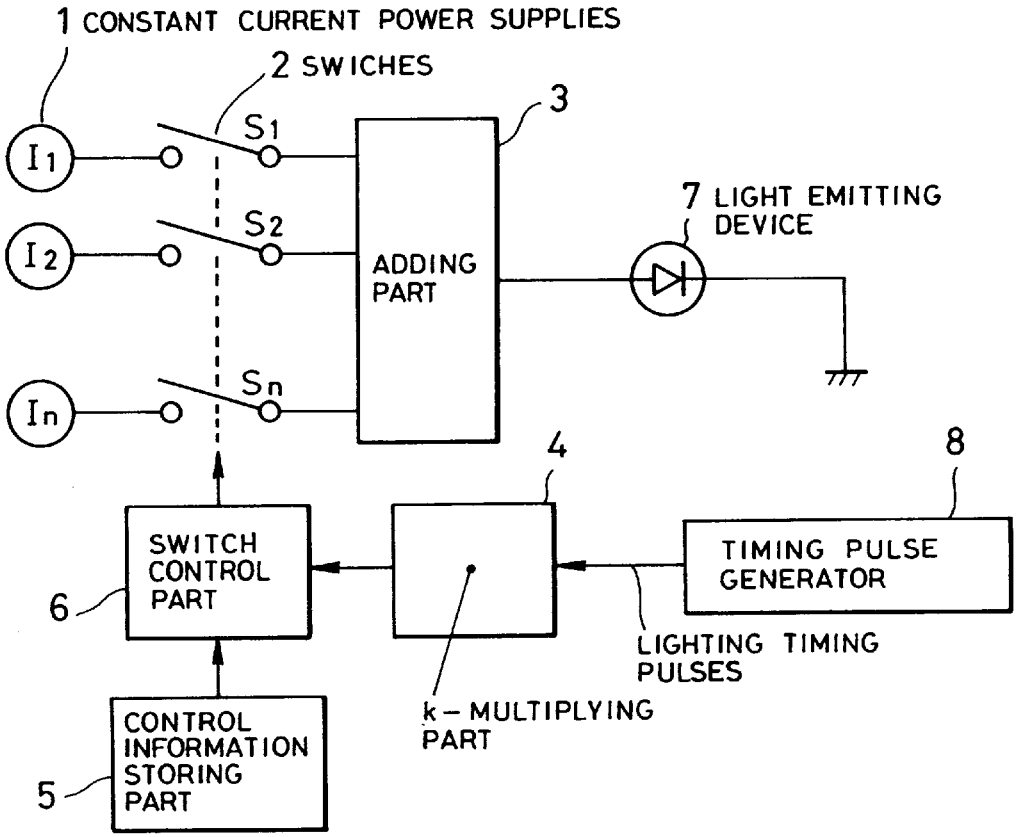
FIG. 1 is a block diagram of an embodiment of the driving apparatus according to the present invention.
FIG. 2 is a drawing showing an example of a control information storing part of the embodiment.

In FIG. 1, the reference numeral 1 denotes a plurality of constant-current power supplies numbering n each having a different output value. The reference numeral 2 denotes a plurality of switches numbering n each of which turns on/off the output of the corresponding constant-current power supply, and the reference numeral 3 denotes an adding part to be used to sum the outputs from the n switches. The reference numeral 7 denotes a light emitting device driven by currents which are summed by the adding part 3, and the reference numeral 4 denotes a k-multiplying part multiplying by k lighting timing pulses determining a lighting period of the light emitting device which are supplied from a timing pulse generator 8. The timing pulse generator 8 may be replaced by any suitable arrangement producing the lighting timing pulses. The reference numeral 5 denotes a control information storing part which stores control information used for determining which of the switches 2 to be turned on/off in each divided timing section of the timing period whose timing has been multiplied by k by the k-multiplying part 4. The reference numeral 6 denotes a switch control part which is used for controlling on/off operation of the switches 2 by reading out a control information corresponding to each timing pulse produced by the k-multiplying part 4.

When a current of $I_1$ is allowed to flow in the light emitting device 7 for one timing section, light is emitted at a luminous intensity of $I_1$ and when it flows at k timing sections, light is emitted at a luminous intensity of $kI_1$. The information concerning which ones of switches $S_1$ to $S_n$ which are generally denoted at 2 are to be turned ON correspondingly to the luminance at which light is emitted from the light emitting device 7 is stored in advance in the control information storing part 5. FIG. 2 is an example of the structure of the control information storing part 5.

As shown in FIG. 2, the part 5 comprises a memory having addresses from 0 to k−1 corresponding to k timing sections produced by the k-multiplying part 4 and stores control information at each address.

The control information at each address consists of an n-digit binary number each digit of which consists of "0" or "1", and the digits are assigned to the switches 2 in such a way that the first digit is assigned to the switch $S_1$, the second digit to the switch $S_2$ and the n-th digit to the switch $S_n$. When the number of each digit is "0", the corresponding switch is turned off and when it is "1", the switch is turned on.

A modulo-k counter (not illustrated) is provided in the switch control part 6 and each time when a pulse is generated by the k-multiplying part 4, the modulo-k counter is incremented by 1.

When the modulo-k counter is updated, the control information stored in the control information storing part 5 is read out by using a count value of the modulo-k counter as an address. If the read value is "0", each of $S_1$–$S_2$ switches 2 is turned OFF and if the value is "1", each switch is turned ON.

FIGS. 3A–3I show an example of the operation by an arrangement including two constant-current power supplies producing currents $I_1$ and $I_2$ respectively, and including two switches $S_1$ and $S_2$ as switches 2, in which the value k in the k-multiplying part is 2.

Of numbers (XX, YY) contained in parentheses shown in FIGS. 3A–3I, the first number "XX" represents information stored at an address "0" in the control information storing part while the second number "YY" represents information stored at an address "1".

Figure 3A:
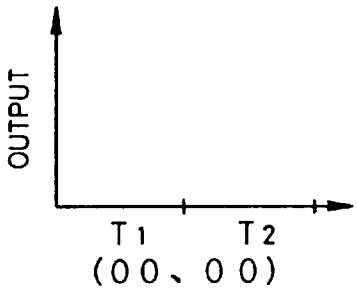
FIGS. 3A–3I are explanatory drawings of the operation in the case where n=2 and k=2.
Figure 3B:
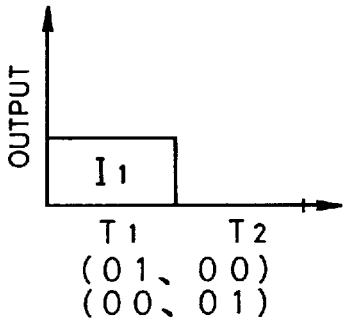
Figure 3C:
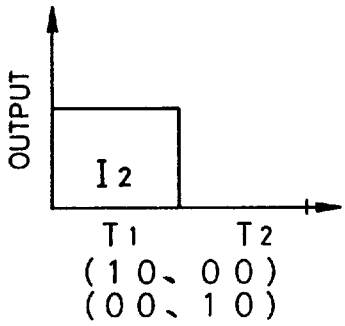
Figure 3D:
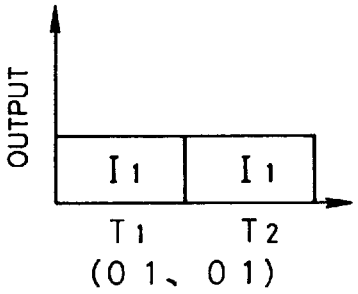
Figure 3E:
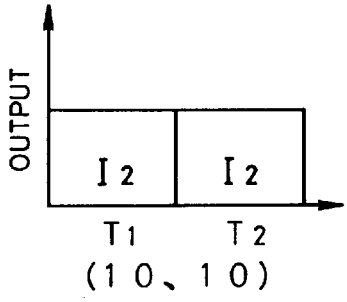
Figure 3F:
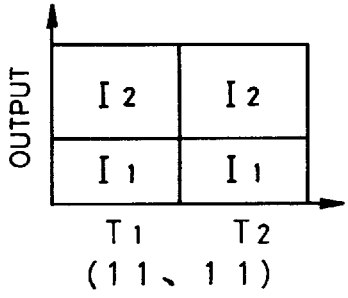

For example, in FIG. 3A, both of the first and second numbers in the parentheses are "00" and "00", which turn off both of the switches $S_1$ and $S_2$. This renders the output of the adder 3 to be "0" and the light emitting device 7 will not be lit. In FIG. 3B, the first number is 01 which turns on the switch $S_1$ at the first timing section $T_1$ and the second number is 00 which turns off the switch $S_1$ at the second timing section $T_2$. This allows the current $I_1$ to flow through the light emitting device 7 and causing the device to be lit at a luminous intensity proportional to $I_1$. In the case of (00, 01) also indicated at the bottom of FIG. 3B, the light emitting device 7 is made luminous in the similar manner as above.

Figure 3G:
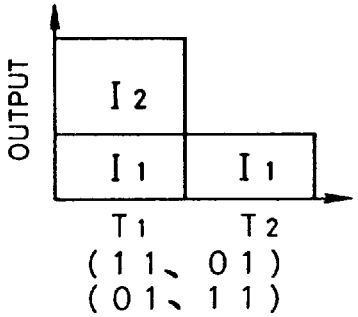
Figure 3H:
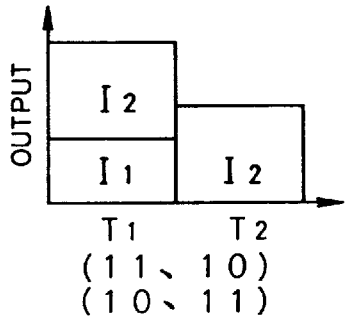
Figure 3I:
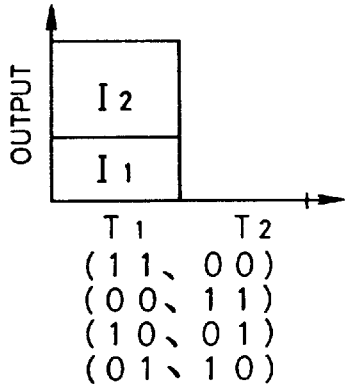

In the case of (11, 01) shown in FIG. 3G, the switches $S_1$ and $S_2$ are turned on, thereby allowing the currents $I_1+I_2$ to flow through the light emitting device 7 during the timing section $T_1$. During the timing section $T_2$ the current $I_1$ is supplied to the device 7, so that the overall luminous intensity of the device 7 becomes proportional to $2I_1+I_2$ Since the driving states shown in the remaining figures of FIGS. 3A–3I are self-explanatory in view of the above explanation, the description thereof is not made here. Thus, as shown in FIGS. 3A–3I, in the case of n=2 and K=2, it is possible to provide 9 luminous steps.

When the division number is K, let us assume that the current value $I_i$ of the i-th one of $I_1$–$I_n$ constant-current power supplies 1 is set as expressed by the following equation (1).

$$I_1=I\cdot(k+1)^{i-1} \tag{1}$$

When n=3 and k=3, the current values of the three constant-current power supplies 1 become as follows.

$$I_1=I\cdot(3+1)^{1-1}=I$$

$$I_2=I\cdot(3+1)^{2-1}4I$$

$$I_3=I\cdot(3+1)^{3-1}=16I \tag{2}$$

Thus, if the current value $I_i$ is selected as indicated above and the current to be flowed is given as mI, the following driving scheme can be selected.

When m is 0, all switches are turned off.

When m is any number from 1 to 3, the current $I_1$ is supplied in m timing sections (maximum number of the sections is 3 (k=3)).

When m is 4, the current $I_2$ is supplied in one timing section.

When m is any number from 5 to 7, the current $I_2$ is supplied in one timing section and the current $I_1$ is supplied in m−4 timing sections.

When m is 8, the current $I_2$ is supplied in two timing sections.

When m is any number from 9 to 11, the current $I_2$ is supplied in two timing sections and the current $I_1$ is supplied in m−8 timing sections.

When m is 12, the current $I_2$ is in three timing sections.

When m is any number from 13 to 15, the current $I_2$ is supplied in three timing sections and the current $I_1$ is supplied in m−12 timing sections.

When m is 16, the current $I_3$ is supplied in one timing section.

.

.

.

When m is 60, both of the currents $I_2$ and $I_3$ are supplied in 3 timing sections.

When m is any number from 61 to 63, both of the currents $I_2$ and $I_3$ are supplied in three timing sections and the current $I_1$ is supplied in m−60 timing sections. . . . (3)

Thus, by turning the corresponding switches on, it is possible to obtain luminous intensity values of 0 to 63 steps. In this way it is possible to effectively obtain a number of current (luminous intensity) values from a few power supplies.

Generally, if the division number and the number of the current values are denoted by k and n respectively, the output value of each current power supply and the total sum of the current values can be expressed as follows:

| Ouput value of each current source | Total sum of current values | (4) |
|---|---|---|
| $I_1 = I_1$ | $S_1 = kI_1$ | |
| $I_2 = S_1 + I_1$ | $S_2 = k(I_1 + I_2)$ | |
| $I_3 = S_2 + I_1$ | $S_3 = k(I_1 + I_2 + I_3)$ | |
| ⋮ | ⋮ | |
| $I_n = S_{n-1} + I_1$ | $S_n = K(I_1 + I_2 + \ldots + I_n)$ | |

Therefore, $$\begin{aligned} S_n &= k(I_1 + I_2 + \ldots + I_{n-1} + S_{n-1} + I_1) \\ &= S_{n-1} + kS_{n-1} + kI_1 \\ &= (k+1)S_{n-1} + kI_1 \end{aligned} \tag{5}$$

and $$S_n+I_1=(k+1)(S_{n-1}+I_1) \tag{6}$$

Now, if $S_j+I_1$ is expressed as $B_j$, then $B_j$ is a geometric progression of a multiple (k+1).

Since $$B_1=S_1+I_1=(k+1)I_1 \tag{7}$$

$$B_n=(k+1)_{n-1}B_1=(k+1)^nI_1 \tag{8}$$

Therefore, $$S_n=\{(k+1)^n-1\}I_1 \tag{9}$$

As a result, $\{(k+1)^n-1\}$ possible values can be obtained. By adding the value 0, total $(k+1)^n$ luminous steps can be achieved.

In the example described above, it is arranged that the control information storing part 6 carries the information to turn on/off the switches for each timing section so that the integrated current value in the lighting period become correspond to the luminance intensity at which the light emitting device 7 is lit. However if there is a difference in light emitting area among the light emitting devices, it becomes impossible to obtain the desired luminance value. For example, in such a light emitting device as an EL (electroluminescence) panel, a desired luminance value cannot be obtained unless an integrated current proportional to a light emitting area is supplied.

Therefore, if a light emitting device having a different luminous area is incorporated in the light emitting part, the control information storing part stores such information that integrated current value is produced by currents values weighted by each of the light emitting areas.

In the embodiment, the lighting timing pulses multiplied by the k-multiplying part are fed to the switch control part 6. Alternatively, output pulses from a pulse generator which generates a pulse at a period of one k-th of lighting period can be supplied in the switch control part 6.

Furthermore, although the constant-current power supplies are used in the embodiment described above, the constant-voltage power supplies can be utilized instead. In the embodiment, as shown in FIG. 2, the control information corresponding to one luminous intensity is stored, however, it is also possible to store information pieces corresponding to a plurality of luminous intensities, so that an information piece corresponding to a desired luminous intensity can be selectively read out.

Figure 4:
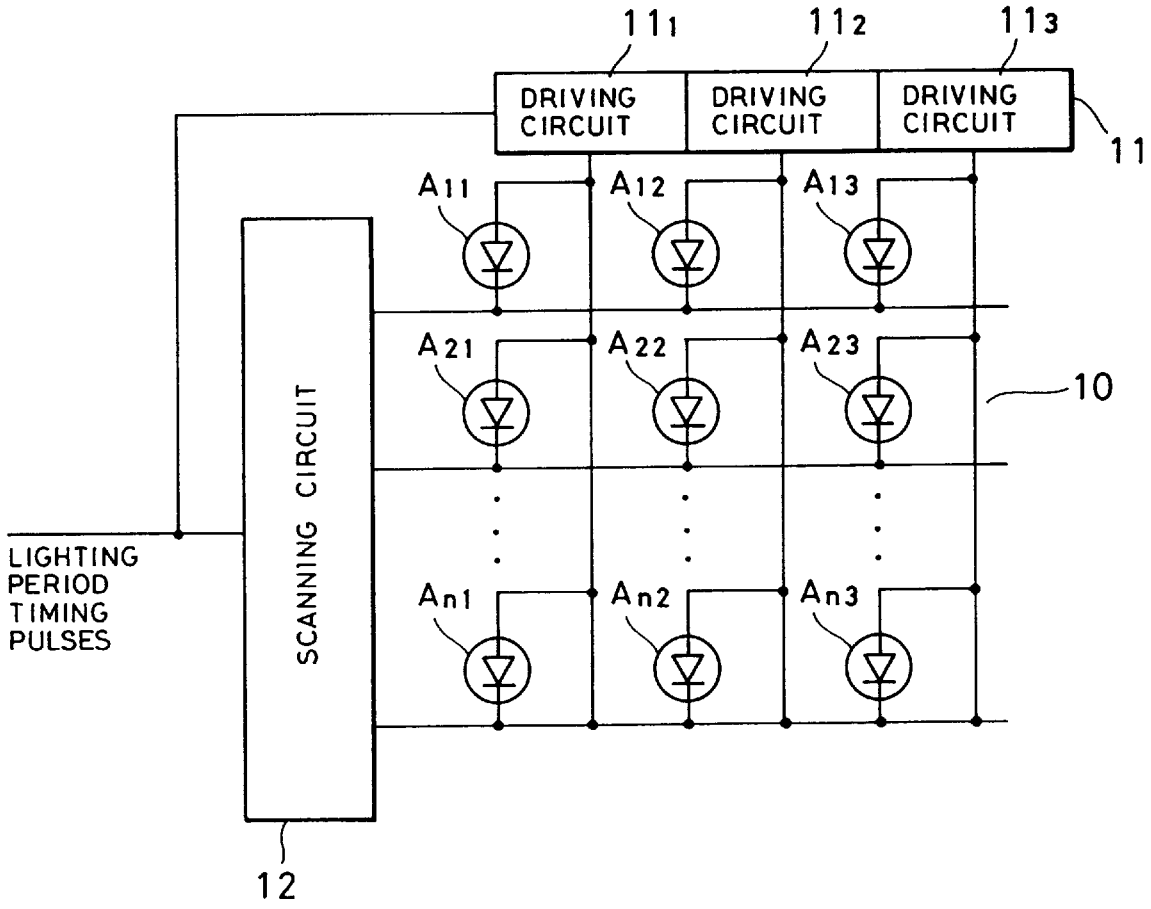
FIG. 4 is a diagram showing the structure of a simple matrix type driving arrangement according to the present invention.

FIG. 4 shows a configuration wherein a plurality of light emitting devices are activated by a simple matrix-type drive apparatus. In the figure, the reference numeral 10 generally denotes light emitting devices $A_{11}$ to $A_{n3}$ arranged in 3 columns and n rows. The reference numeral 11 generally denotes driving circuits ($\mathbf{11}_1$–$\mathbf{11}_3$) used commonly for each column and the reference numeral 12 denotes a scanning circuit.

Each of the driving circuits ($\mathbf{11}_1$–$\mathbf{11}_3$) is made up of various parts shown in FIG. 1. The scanning circuit 12 repeatedly connects to ground a plurality of lighting lines numbering n which are connected to the corresponding light emitting devices sequentially for the time period T which is the period shown in 3A to 3J. When the lighting line is grounded, the current flow from the driving circuit to the light emitting devices activate them.

If the shape and the luminance of each of the light emitting devices $A_{11}$ to $A_{1n}$ connected to the first line are identical among the light emitting devices, then the control information stored in the control information storing part 5 in the driving circuit 1 shown in FIG. 1 can be identical as well for all the light emitting devices $A_{11}$ to $A_{1n}$. If, however, the area and the luminance of each of the light emitting devices are different among the light emitting devices, the information piece corresponding to the area and luminance of each of the light emitting devices is stored for all of the light emitting devices, so that the corresponding control information piece can be read out for controlling operation in synchronization with the sequential grounding of the n lighting lines by the scanning circuit. This allows the n light emitting devices to be activated by using one signal line from the driving circuit and also the light emitting device to be simply configured even if the area and luminance are made different among the light emitting devices.

As hereinabove described, the following effects can be obtained according to the present invention.

The outputs of n power supplies each generating a different output are summed by means of the switches connected to the power supplies respectively, and the light emitting device is driven by the summed output. By turning the switches on/off based on the information stored for each divided section of the device's lighting period which is divided by k. In this way, the number of the power supplies each having a different output can be decreased, thus allowing the cost of the device to be reduced and the light emitting device can be driven by utilizing all the divided sections of lighting period. This allows the peak of the driving values to be lowered and the driving of the light emitting device at a low speed.

Moreover, the method and apparatus according to an aspect of the present invention are configured that the i-th power supply of the n power supplies produces an output which is proportional to $(k+1)^{i-1}$, so that many steps of the driving value are obtained by few numbers of the power supplies.

According to the other aspect of the invention, the switches are turned on/off in such a manner that the on/off switch control values for each divided section of lighting period are weighted according to the areas of light emitting devices, thus allowing a particular light emitting device to be activated at desired luminance even if the light emitting devices having different areas are incorporated in the display unit.

In addition, the power supply is easily performed because the power supply part is made by using either the constant-current or constant-voltage type power supplies.

Furthermore, in one embodiment, the control information pieces to turn on/off the n outputs are prepared for a plurality of light emitting devices, so that the light emitting devices are in turn driven using the corresponding ones of the prepared plurality of control information pieces. This allows a structure that a single output drives a plurality of light emitting devices, so that the structure of the display apparatus can be simplified.

Although the invention has been described in its preferred forms, it will be obvious to those skilled in the art that various changes and modifications may be made, and it is intended to cover in the appended claims all such modifications and variations as fall within the spirit and scope of the invention.

What is claimed is:

1. A driving method for driving a light emitting device, comprising the steps of:

generating n driving outputs different from each other, n being an integer; and driving said light emitting device by a drive signal obtained by summing selected ones of said n driving outputs, wherein said driving step includes steps of dividing a lighting period of said light emitting device into k sections, k being an integer, and switching on/off each of said driving outputs for each divided section of said lighting period, thereby performing a selection of driving outputs.

2. A driving method for a light emitting device as claimed in claim 1, wherein said driving outputs are switched on/off for a plurality of light emitting elements which together constitute said light emitting device and said driving outputs are repeatedly switched on/off correspondingly to said light emitting elements to be activated sequentially so that said driving outputs are summed to produce said drive signal.

3. A driving method for a light emitting device as claimed in claim 2, wherein an output value of an i-th driving output, i being an integer, of n different driving outputs is determined to be $I\cdot(k+1)^{i-1}$ where k represents the number of divided sections of said lighting period and I represents a minimum output value.

4. A driving method for a light emitting device as claimed in claim 2, wherein in each of said divided sections said driving outputs are switched on/off based on values weighted by light emitting areas of said light emitting elements in said light emitting device.

5. A driving method for a light emitting device as claimed in claim 3, wherein in each of said divided sections said driving outputs are switched on/off based on values weighted by light emitting areas of said light emitting elements in said light emitting device.

6. A driving method for a light emitting device as claimed in claim 2, wherein said n driving outputs are one of a constant-current driving type and a constant-voltage type.

7. A driving method for a light emitting device as claimed in claim 3, wherein said n driving outputs are one of a constant-current driving type and a constant-voltage type.

8. A driving method for a light emitting device as claimed in claim 4, wherein said n driving outputs are one of a constant-current driving type and a constant-voltage type.

9. A driving method for a light emitting device as claimed in claim 5, wherein said n driving outputs are one of a constant-current driving type and a constant-voltage type.

10. A driving apparatus for driving a light emitting device, comprising:

n power supplies each generating a different output, n being an integer;

n switching means to turn on/off each of the outputs from said n power suppliers, respectively;

summing means for summing outputs from said n switching means and driving said light emitting device by a summed signal;

period dividing means for dividing a lighting period of said light emitting device into k sections, k being an integer;

control information storing means for storing control information to turn on/off said n switching means for each of the k divided sections of said lighting period obtained by using said period dividing means; and switch control means for reading out control information from said control information storing means for each of the k divided sections of said lighting period obtained by said period dividing means and for turning on/off said n switching means.

11. A driving apparatus for a light emitting device as claimed in claim 10, wherein said control information to be stored in said control information storing means are information pieces corresponding to a plurality of light emitting elements which together constitute said light emitting device, and said switch control means performs a control operation by reading each of the information pieces from said control information storing means corresponding to one of the light emitting elements to be activated in sequential order.

12. A driving apparatus for a light emitting device as claimed in claim 11, wherein an output value of an i-th power supply, i being an integer, of said n different power supplies is determined to be $I\cdot(k+1)^{i-1}$ where k represents the number of divisions of said lighting period and I represents a minimum output value.

13. A driving apparatus for a light emitting device as claimed in claim 11, wherein control information stored in said control information storing means is information for turning on/off said n switching means for each of said divided sections which is weighted according to light emitting areas of said light emitting elements in said light emitting device.

14. A driving apparatus for a light emitting device as claimed in claim 12, wherein control information stored in said control information storing means is information for turning on/off said n switching means for each of said divided sections which is weighted according to light emitting areas of said light emitting elements in said light emitting device.

15. A driving apparatus for a light emitting device as claimed in claim 11, wherein said n power supplies are one of a constant-current type and a constant-voltage type.

16. A driving apparatus for a light emitting device as claimed in claim 12, wherein said n power supplies are one of a constant-current type and a constant-voltage type.

17. A driving apparatus for a light emitting device as claimed in claim 13, wherein said n power supplies are one of a constant-current type and a constant-voltage type.

18. A driving apparatus for a light emitting device as claimed in claim 14, wherein said n power supplies are one of a constant-current type and a constant-voltage type.

19. A driving method for driving a light emitting device, comprising the steps of:

generating n driving outputs, each of said n driving outputs having a different output level;

dividing a lighting period of said light emitting device into k sections;

switching on/off each of said n driving outputs for each divided section of said lighting period;

summing the output levels of the driving outputs that are switched on in said lighting period to produce a drive signal; and driving said light emitting device by said drive signal.

20. The method of claim 19, further the step of generating comprises the step of generating n driving outputs, wherein an output value of an with driving output of n different driving outputs is determined to be $I\ (k+1)^{i-1}$ where k represents the number of divided sections of said lighting period and I represents a minimum output value.

* * * * *